United States Patent [19]

Koizumi

[11] Patent Number: 4,953,724

[45] Date of Patent: Sep. 4, 1990

[54] JIB STRETCHING AND FOLDING DEVICE

[75] Inventor: Yukio Koizumi, Akashi, Japan

[73] Assignee: Kabushiki Kaisha Kobe Seiko Sho, Kobe, Japan

[21] Appl. No.: 373,027

[22] Filed: Jun. 29, 1989

[51] Int. Cl.[5] ..... B66C 23/42

[52] U.S. Cl. ..... 212/188; 212/266

[58] Field of Search ..... 212/168, 187, 188, 266, 212/267

[56] References Cited

U.S. PATENT DOCUMENTS 4,595,108 6/1986 Koizumi et al. ..... 212/267

*Primary Examiner*—Sherman Basinger

*Assistant Examiner*—Thomas J. Brahan

*Attorney, Agent, or Firm*—Oblon, Spivak, McClelland, Maier & Neustadt

[57] ABSTRACT

In a crane capable of folding a strut type jib along a vertical side surface of a boom and also capable of stretching the jib from such a folded condition in a so-called twisting fashion, a jib stretching and folding device includes a twist shaft for jib stretching and folding operation located below a lower member of the jib under the jib folded condition, so as to fold the jib at an upper position aside the boom. Furthermore, the twist shaft is movable toward and away from the forward end of the boom, so as to fold the jib at a position shifted to the base end of the boom. The advance condition of the twist shaft to the forward end of the boom can be fixed so as to prevent movement of the jib to the forward end of the boom.

21 Claims, 24 Drawing Sheets

JIB STRETCHING AND FOLDING DEVICE

BACKGROUND OF THE INVENTION AND RELATED ART STATEMENT

The present invention relates to a jib stretching and folding device in a wheel type crane such as a truck crane and a rough terrain crane for stretching and folding a strut type jib (which will be hereinafter referred simply to as a jib) in a so-called jib twisting fashion.

There will first be described a basic construction of the prior art device for stretching and folding the jib in the twisting fashion and a folding operation of the jib with reference to FIGS. 26 to 29.

(I) A boom 1 is provided at its forward end portion with a pair of jib mounting shafts 11 and 12 projecting laterally in opposite directions.

(II) A jib 2 has a pair of left and right beams 2*a* and 2*b* (the terms "left" and "right" will be hereinafter defined as viewed from an operator cab under the stretched condition of the jib), and the left and right beams 2*a* and 2*b* are provided at their respective base ends with a pair of formed jib feet 21 and 22 adapted to be disengageably connected to the jib mounting shafts 11 and 12, respectively.

(III) The left jib foot 21 is a movable jib foot rotatable about its axis, and the right jib foot 22 is a fixed jib foot non-rotatable about its axis.

(IV) When the jib 2 is used, the movable jib foot 21 is engaged with the left jib mounting shaft 11, and the fixed jib foot 22 is engaged with the right jib mounting shaft 12. Under this condition, the jib 2 is stretched from the forward end of the boom 1, and is supported by a suspension rod S.

FOLDING OPERATION OF THE JIB (1) The suspension rod S is removed, and the fixed jib foot 22 is disengaged from the right jib mounting shaft 12. Under the condition where the movable jib foot 21 is maintained engaged with the left jib mounting shaft 11, the jib 2 is suspended from the forward end of the boom 1 while being supported by a wire rope W with its one end fixed to a free end portion of the jib 2 as shown by a phantom line in FIG. 26.

(2) Then, the wire rope W is released from the free end portion of the jib 2, and the jib 2 is twisted about the axis of the movable jib foot 21 at about 270° as shown in FIG. 28.

(3) The wire rope W is wound on a guide sheave 23 provided at a free end of the jib 2, and the one end of the wire rope W is fixed to a base portion of the boom 1. Under this condition, the wire rope W is slowly hoisted to pivot the jib 2 about the left jib mounting shaft 11 and thereby draw the jib 2 toward a left side surface of the boom 1 as shown in FIG. 29.

(4) After the step (3), the jib 2 is fixed at its base portion and free end portion by known fixing means (not shown).

Thus, the jib 2 is folded along the left side surface of the boom 1 in such a manner that the left beam 2*a* is disposed below the right beam 2*b*.

In the prior art device, the jib 2 is pivoted at the movable jib foot 21 provided at the base end of the left beam (i.e., the lower beam in the folded condition) 2*a* of the jib 2 until the jib 2 is folded along the left side surface of the jib 2. Therefore, a large part of the left beam 2*a* of the jib 2 (which part is hatched in FIG. 29) projects below a lower surface of the boom 1 under the folded condition of the jib 2. Such a projecting portion of the jib 2 will hinder the front view from the operator cab during traveling of the crane. Especially in the case of the rough terrain crane wherein a front overhang length of the boom from the operator cab is so large as to deteriorate the front view, the above-mentioned projecting portion of the jib 2 obstructs the safe traveling of the crane.

A device for solving this problem is disclosed in Japanese Patent Laid-open Publication No. 61-86386 and Japanese Utility Model Laid-open Publication No. 61-72583. In the prior art device, the jib is connected through a sheave to the boom after drawing the jib toward the side surface of the boom, and the boom is expanded to raise the jib to an upper position, so as to reduce the aforementioned projecting portion. However, an additional step for raising the jib is required in the jib folding operation (or a lowering step for lowering the jib is required in the jib stretching operation). Therefore, the jib folding and stretching operations become troublesome.

SUMMARY OF THE INVENTION

It is an object of the present invention to provide a jib stretching and folding device for a crane which may eliminate the above-mentioned defects.

The other objects and advantages of the present invention will become more apparent in the following description.

According to a first aspect of the present invention, there is provided in a crane including a telescopic boom having a forward end portion provided with a pair of jib mounting shafts laterally projecting from opposite side surfaces of said forward end portion, and a strut type jib having a base end portion provided with a pair of jib feet adapted to be detachably connected with said jib mounting shafts, wherein said jib is folded along one of vertical side surfaces of said boom under the condition where said jib feet are disposed in vertical arrangement, while said jib is stretched from said forward end portion of said boom under the condition where said jib feet are connected to said jib mounting shafts; a jib stretching and folding device comprising a connecting member adapted to be detachably connected to one of said jib mounting shafts to which one of said jib feet arranged at a lower position under the jib folded condition is to be connected in a stretching operation of said jib, independently of said lower one of said jib feet and in such a manner as to be rotatable about said one jib mounting shaft, and a supporting shaft mounted to a lower member of said jib at the base end portion of said jib under the jib folded condition in such a manner as to extend below said lower member, wherein said connecting member is supported to said supporting shaft in such a manner as to be rotatable about said jib.

With this arrangement, the jib is twisted about the supporting shaft in the stretching and folding operation of the jib. In the folding operation, the jib is drawn toward the vertical side surface of the boom under the condition where the lower member of the jib is disposed above the jib mounting shaft. That is, a raising operation of the jib is not especially required but the jib is automatically raised by drawing the jib toward the vertical side surface of the boom.

According to a second aspect of the present invention, said connecting member is supported to said supporting shaft in such a manner as to be rotatable about said supporting shaft and be slidable along said supporting shaft to advance toward the base end portion of said jib and retract therefrom, and means for fixing said connecting member in its advance condition is provided.

With this arrangement, in addition to the aforementioned advantage, the jib can be shifted back toward the base end of the boom under the advance condition of the connecting member. Accordingly, as compared with the prior art device wherein the jib foot is engaged with the jib mounting shaft in the jib folding operation, the center of gravity of the boom may be shifted toward the base end of the boom owing to the shifted-back distance of the jib, thereby reducing an overturning moment of the crane and improving the weight balance of front and rear axles owing to the weight of the boom during traveling of the crane.

Further, in drawing the jib toward the side surface of the boom in the jib folding operation or in releasing the fixation of the jib under the condition where the boom is inclined downwardly at the forward end thereof in the jib stretching operation, the jib is prevented from being moved toward the forward end of the boom since the connecting member is fixed in its advance condition. Therefore, the folding and stretching operations of the jib may be carried out smoothly and safely.

According to a third aspect of the present invention, the jib stretching and folding device as mentioned in the first aspect further comprises a bracket mounted on said lower member of said jib, wherein said supporting shaft comprises a rod supported to said bracket in such a manner as to be rotatable about an axis of said rod and extend in substantially parallel relationship to said lower member of said jib, and said connecting member is connected to an end of said rod.

According to a fourth aspect of the present invention, the jib stretching and folding device as mentioned in the second aspect further comprises a bracket mounted on said lower member of said jib, wherein said supporting shaft comprises a rod supported to said bracket in such a manner as to be rotatable about an axis of said rod extending in substantially parallel relationship to said lower member of said jib and be slidable along the axis to advance toward the base end portion of said jib and retract therefrom, and said connecting member is connected to an end of said rod.

With the above construction of the third and fourth aspects, the mounting structure of the connecting member is simplified.

According to a fifth aspect of the present invention, said means for fixing said connecting member in its advance condition comprises a stopper provided on said bracket and a member fixed to said rod and adapted to abut against said stopper from the side of the base end portion of said jib under the jib folded condition.

With this arrangement, the fixing structure may be simplified, and the advance condition of the connecting member may be reliably fixed.

According to a sixth aspect of the present invention, said means for fixing said connecting member in its advance condition comprises a circumferential groove formed on said rod and a pin mechanism mounted to said bracket, said pin mechanism comprising a fixing pin engageable with said circumferential groove under the advance condition of said connecting member and a spring for biasing said fixing pin in such a direction as to bring said fixing pin into engagement with said circumferential groove.

With this arrangement, the advance condition of the connecting member may be reliably fixed. That is, the jib is reliably prevented from being moved toward the forward end of the boom.

According to a seventh aspect of the present invention, said rod comprises a hollow shaft, and said means for fixing said connecting member in its advance condition comprises a first pin hole formed through a circumferential wall of said hollow shaft and a fixing pin mechanism mounted to said bracket, said fixing pin mechanism comprising a fixing pin engageable with said pin hole under the folded condition of said jib and a spring for biasing said fixing pin in such a direction as to bring said fixing pin into engagement with said pin hole.

With this arrangement, the advance condition of the connecting member may be reliably fixed.

According to an eighth aspect of the present invention, the means for fixing the connecting member in its advance condition as mentioned in the seventh aspect further comprises a second pin hole formed through the circumferential wall of said hollow shaft and adapted to be engaged with said fixing pin under the stretched condition of said jib, wherein said first and second pin holes are arranged on the same circle.

With this arrangement, the connecting member may be reliably fixed in its advance condition during the jib folding operation. In addition, when the jib is twisted in the folding direction, the fixing pin comes into engagement with the first pin hole, while when the jib is twisted in the stretching direction, the fixing pin comes into engagement with the second pin hole. Therefore, the jib may be precisely twisted at a predetermined twist angle defined by the location of the first and second pin holes.

According to a ninth aspect of the present invention, said pin hole is formed with a slant surface in a circumferential direction of said rod for permitting said fixing pin to disengage from said pin hole in the circumferential direction of said rod.

With this arrangement, the fixing pin may be automatically released from the pin hole by a twisting force in twisting the jib in the jib folding and stretching operations.

According to a tenth aspect of the present invention, an end portion of said rod is bent in such a manner that said connecting member is located close to the side surface of said boom.

With this arrangement, as the connecting member is connected to the jib mounting shaft at a position close to the side surface of the boom, a lateral projecting length of the jib mounting shaft may be reduced.

According to an eleventh aspect of the present invention, an end portion of said rod is bent in such a manner that the lower jib foot and the connecting member are aligned under the stretched condition of the jib, and the bent portion and said connecting member are formed by a pair of parallel plates adapted to diametrically hold said jib mounting shaft.

With this arrangement, the connecting member and the jib foot can be selectively connected in alignment with each other. Accordingly, a dedicated mounting portion for mounting the connecting member is not required, thereby minimizing the lateral projecting length of the jib mounting shaft.

According to a twelfth aspect of the present invention, said connecting member has a forked structure adapted to be disengageably connected to said jib mounting shaft.

With this structure, the connecting member can be easily connected to the jib mounting shaft and easily disconnected therefrom.

According to a thirteenth aspect of the present invention, said connecting member has a ring-like structure, and said jib mounting shaft to be connected with said ring-like connecting member comprises a main mounting portion fixed to said boom and a hollow pin-like auxiliary mounting portion detachably connected to said main mounting portion.

With this structure, when the jib is not used, the auxiliary mounting member may be removed, so that the lateral projecting length of the jib mounting shaft projecting from the side surface of the boom may be reduced. Accordingly, this construction is advantageous for the crane operation when the boom is placed in a narrow space.

Figure 1:
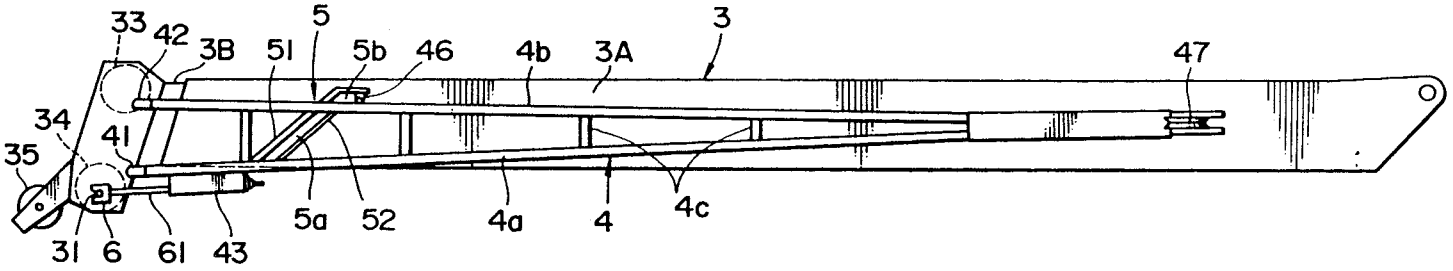
FIG. 1 is a side view of the jib under the folded condition according to a first preferred embodiment of the present invention.

DETAILED DESCRIPTION OF THE PREFERRED EMBODIMENTS (1) First Preferred Embodiment (see FIGS. 1–11)

A boom 3 is normally constructed of a base boom and plural stages of movable booms. For better understanding, there is shown a single stage telescopic boom 3 constructed of a base boom 3A and a single stage movable boom 3B. A jib 4 has a tapering ladder-like structure constructed of left and right beams **4*a* and 4*b* and a plurality of cross bars 4*c* connecting the beams 4*a* and 4*b***.

The movable boom **3*b* is provided at its forward end portion with left and right jib mounting shafts 31 and 32 projecting horizontally in opposite directions. The left jib mounting shaft 31 is constructed of a main mounting portion 31*a* having a length equal to that of the right jib mounting shaft 32 and an auxiliary mounting portion 31*b* integrally extending from the main mounting portion 31*a* (see FIGS. 5, 6, 9 and 11**).

Figure 2:
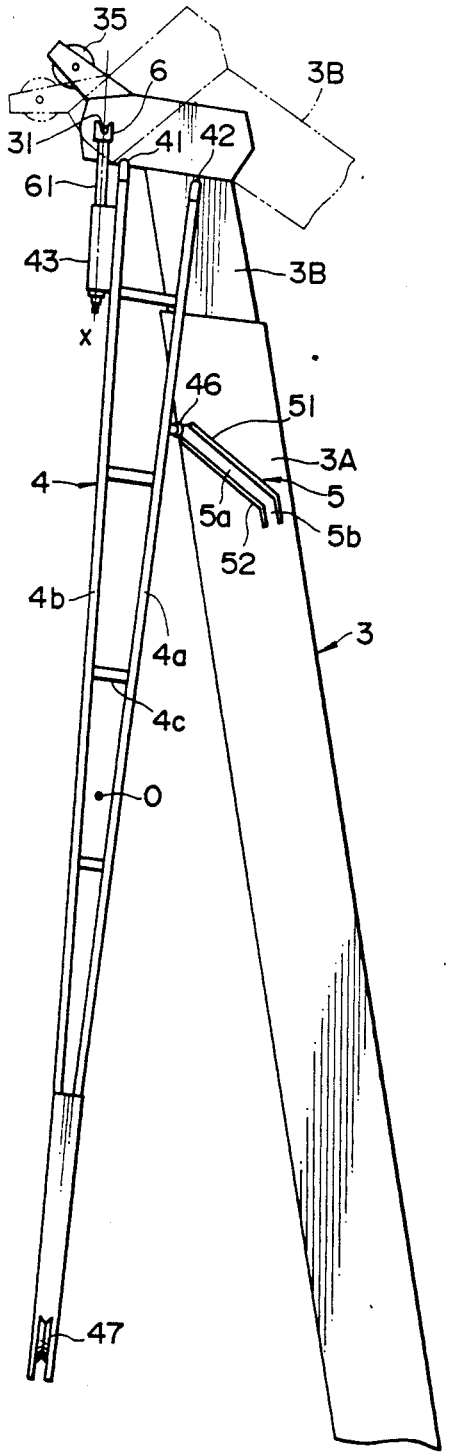
FIG. 2 is a side view of the jib under the suspended condition.

Referring to FIGS. 1 and 2, reference numeral 5 designates a known jib guide provided on a left side surface of the base boom 3A at the forward end portion thereof. The jib guide 5 is constructed of a pair of parallel guide rails 51 and 52 bent like an inverted V-shape to form a guide channel composed of a slant channel portion **5*a* inclined downwardly toward the forward end of the boom under the horizontal condition of the boom and a horizontal channel portion 5*b* continuing from a rearward end of the slant channel portion 5*a*. An idler sheave 33, a main sheave 34 and an auxiliary sheave 35 are provided at the forward end of the movable boom 3B**.

Figure 8:
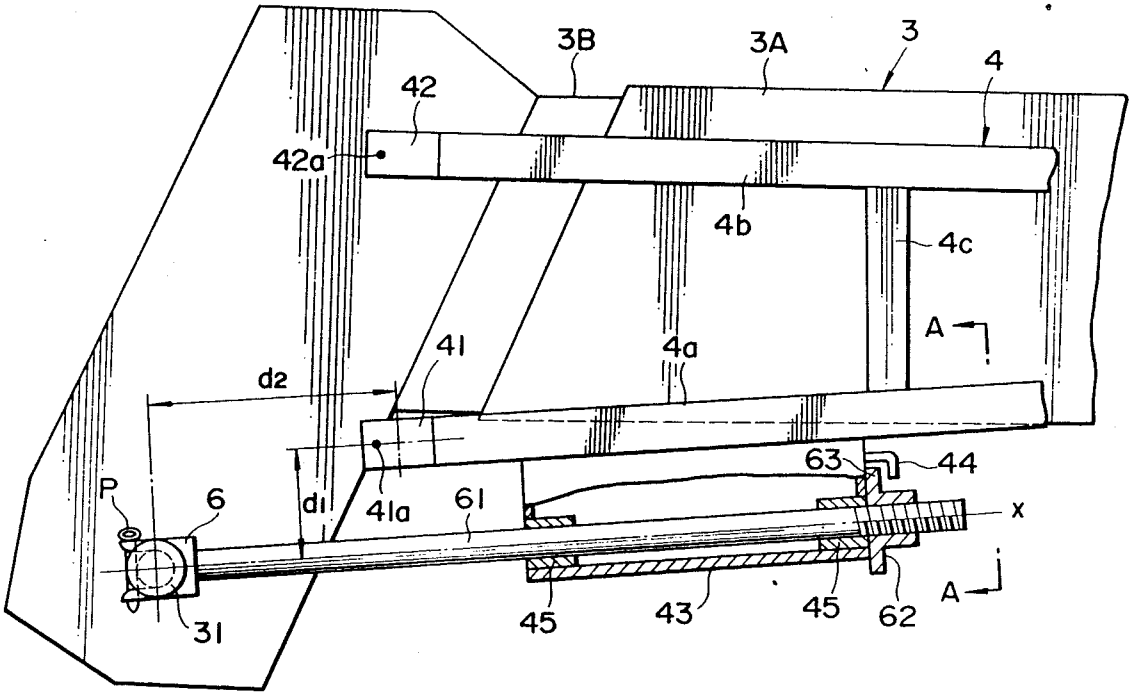
FIG. 8 is an enlarged side view, partially in section; of the essential part in FIG. 1.
Figure 9:
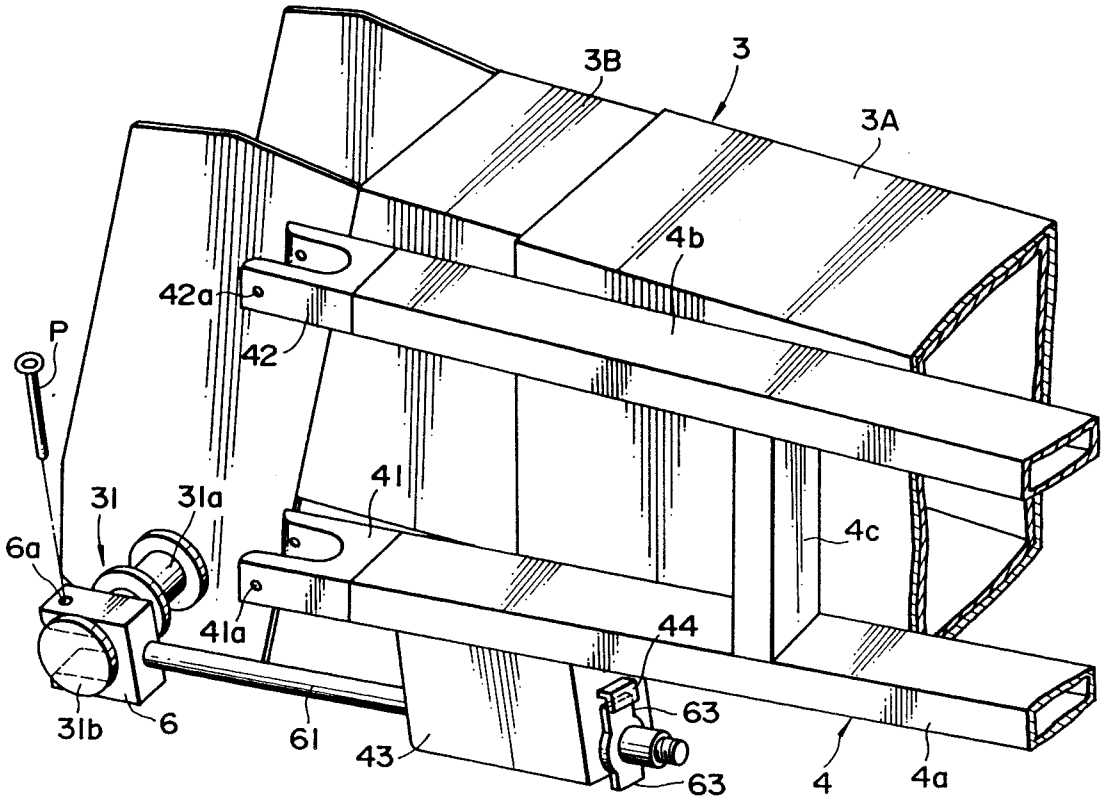
FIG. 9 is a perspective view of FIG. 8.

As shown in FIGS. 8 and 9, forked jib feet 41 and 42 are fixed to base ends of the beams **4*a* and 4*b* of the jib 4, respectively. The jib feet 41 and 42 are formed with fixing pin holes 41*a* and 42*a***, respectively.

Figure 6:
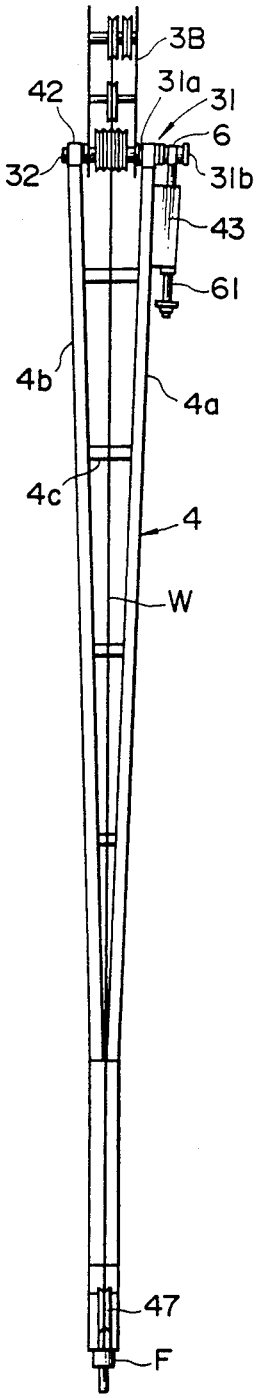
FIG. 6 is an elevational view of the jib raised vertically from the position shown in FIG. 5.
Figure 7:
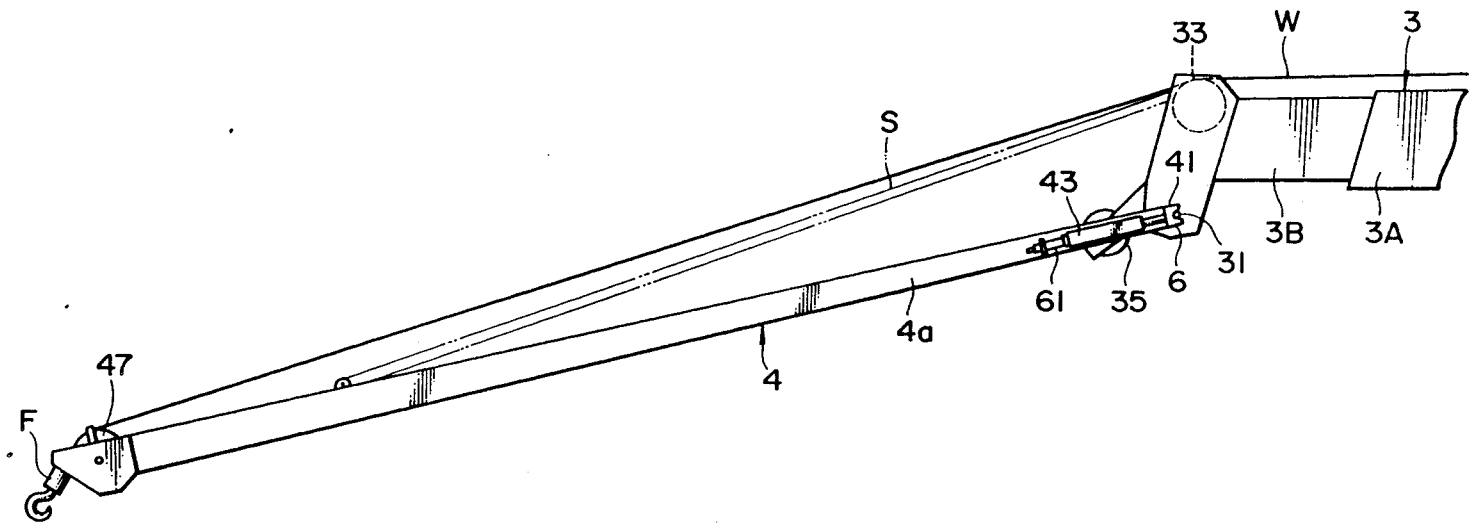
FIG. 7 is a side view of the jib under the stretched condition.
Figure 11:
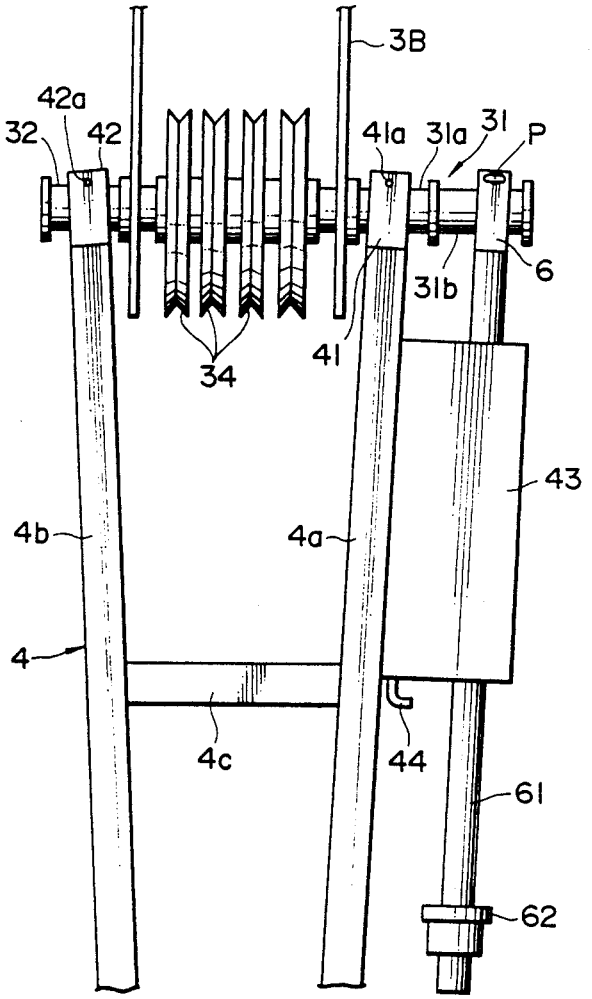
FIG. 11 is an enlarged elevational view of the essential part in FIG. 6.

In a use condition of the jib 4 as shown in FIGS. 6, 7 and 11, the jib feet 41 and 42 are engaged with the jib mounting shafts 31 and 32, and the jib 4 is so disposed as to extend from the forward end of the boom 3. On the other hand, in a non-use condition of the jib 4 as shown in FIGS. 1, 8 and 9, the jib 4 is so disposed as to extend along the left side surface of the boom 3 in a vertical condition such that the left beam **4*a* and the left jib foot 41 are positioned under the right beam 4*b* and the right jib foot 42, and the jib 4** is fixed by known fixing means (not shown).

Under the folded condition of the jib 4, a box-like bracket 43 is fixed to a lower surface of the lower beam **4*a* of the jib 4 at the base end portion thereof. The bracket 43 is connected through a supporting shaft in the form of a rod 61 to a connecting member 6. The connecting member 6 is forked like the jib feet 41 and 42, and is fixed to one end of the rod 61. The rod 61 is disposed below the lower beam 4*a* in parallel relationship thereto at a predetermined distance $d_1$ (see FIG. 8), and is supported to the bracket 43 in such a manner as to be rotatable about an axis x of the rod 61** and be slidable along the axis x.

Accordingly, the connecting member 6 is rotatable about the axis x of the rod 61, and is slidable along the axis x. The rod 61 may be slightly inclined relative to an axis of the lower beam 4a.

A thrust plate 62 is threadedly fixed to the other end of the rod 61. When the thrust plate 62 is in abutment against an end surface of the bracket 43 on the opposite side of the connecting member 6, the rod 61 and the connecting member 6 are advanced by the maximum with respect to the base end of the jib 4 (which condition will be hereinafter referred to as an advance condition). When the rod 61 is slid from this advance condition toward a free end of the jib 4, a retract condition of the connecting member 6 is obtained. Under the advance condition, the connecting member 6 is disposed at a distance $d_2$ (see FIG. 8) from the lower (left) jib foot 41, and is engageable with the auxiliary mounting portion 31b of the left jib mounting shaft 31.

Figure 10:
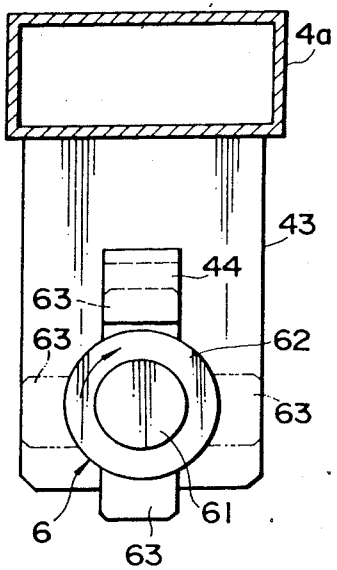
FIG. 10 is a cross section taken along the line A—A in FIG. 8.

As shown in FIGS. 8 to 10, the thrust plate 62 is formed at its outer circumference with a pair of projections 63 at opposite positions. Under the folded condition of the jib 4, one of the projections 63 appropriately selected abuts against a stopper 44 provided on the end surface of the bracket 43 to stop the retract movement of the rod 61 and the connecting member 6 (which operation will be hereinafter described in more detail). A pair of bearing members 45 are located in the bracket 45 so as to bear the rod 61 rotatably and slidably. As shown in FIG. 9, the connecting member 6 is formed at its forked portion with a pair of pin holes 6a for inserting a fixing pin P thereinto.

As shown in FIGS. 1 and 2, a guide roller 46 is provided on an upper surface of the upper beam 4b at its base end portion under the folded condition of the jib 4. In stretching the jib, the guide roller 46 is guided by the jib guide 5 of the boom 3 to move the jib 4 from the folded position shown in FIG. 1 to the suspended position shown in FIG. 2. In folding the jib 4, the jib 4 is moved in a manner reversed to the above.

There will now be described the operation of the preferred embodiment.

STRETCHING OPERATION OF THE JIB

The jib 4 is fixed at its free end and intermediate position to the left side surface of the base boom 3A under the folded condition. At this time, the guide roller 46 is engaged with the horizontal channel portion 5b of the jib guide 5.

(a) Under the condition where the boom 3 is fully contracted, and is laid substantially horizontally, the connecting member 6 is engaged with the auxiliary mounting portion 31b of the left jib mounting shaft 31, and the fixing pin P is inserted into the pin holes 6a of the connecting member 6, so as to connect the connecting member 6 to the auxiliary mounting portion 31b disengageably and rotatably with respect thereto.

(b) The fixation of the jib 4 is released. Then, the boom 3 is derricked up at about 80°, and is simultaneously expanded.

By the expansion of the boom 3, the guide roller 46 is moved from the horizontal channel portion 5b of the jib guide 5 to the outside thereof as shown in FIG. 2. As a result, the jib 4 is suspended only by the left jib mounting shaft 31 (the auxiliary mounting portion 31b). Reference character O shown in FIG. 2 denotes a center of gravity of the jib 4.

Figure 3:
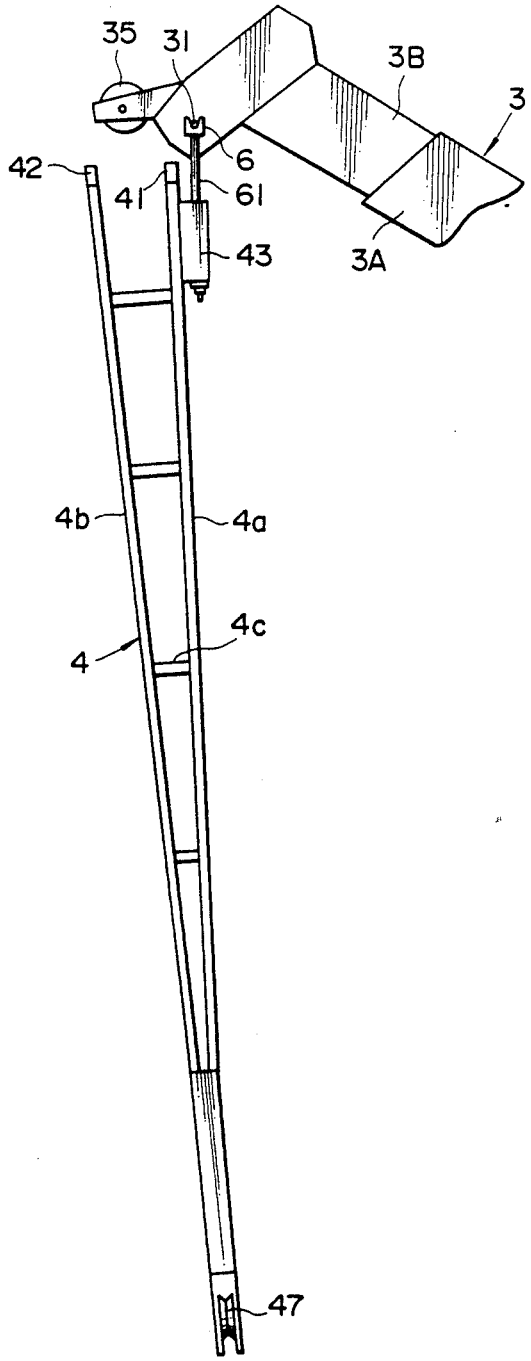
FIG. 3 is a side view of the jib during the twisting operation.

(c) Then, the jib 4 is twisted at about 180° about the axis x of the rod 61 as shown in FIG. 3, and subsequently the jib 4 is twisted at about 90° about the axis x of the rod 61 to obtain the condition shown in FIGS. 4 and 5.

Figure 4:
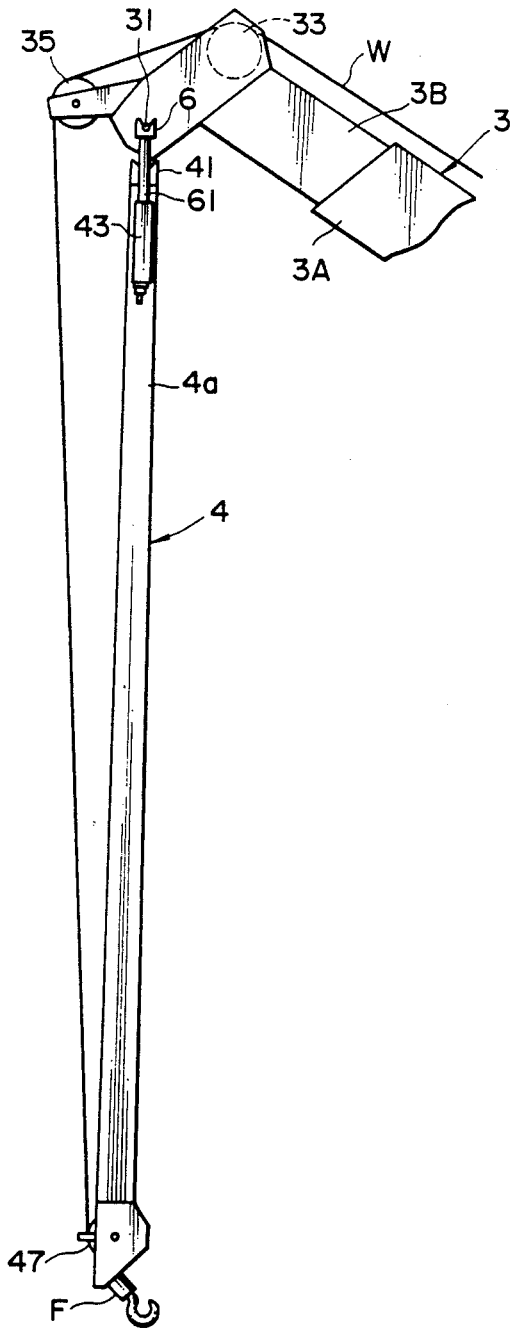
FIG. 4 is a side view of the jib at the end of the twisting operation.
Figure 5:
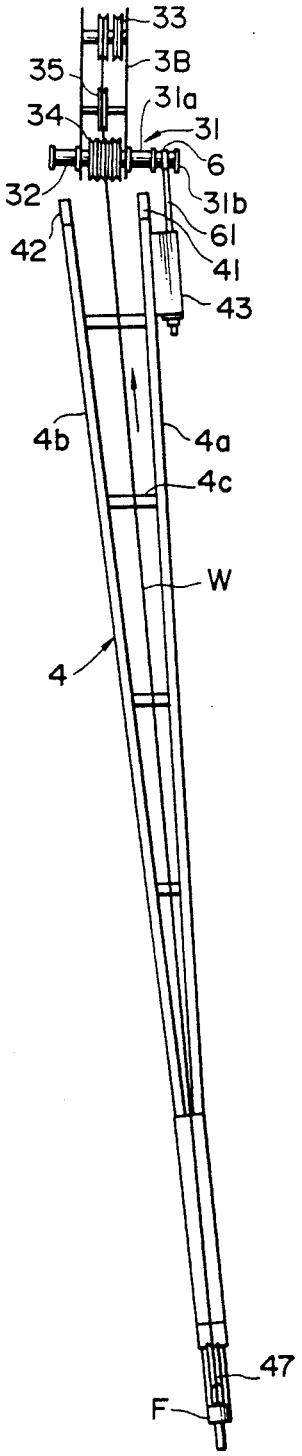
FIG. 5 is an elevational view of FIG. 4.

Under the condition as shown in FIGS. 4 and 5, the jib feet 41 and 42 are opposed to the jib mounting shafts 31 and 32 from the under side, respectively. Further, as the jib 4 is twisted at about 270° from the condition shown in FIG. 2, the stopper 44 of the bracket 43 is also rotated at about 270°, and it is therefore brought into disengagement from the projection 63 of the thrust plate 62 (see the phantom line shown in FIG. 10). Accordingly, the rod 61 is allowed to be retracted. That is, the jib 4 can be moved to the forward end of the boom 3 relative to the rod 61.

(d) A wire rope W preliminarily wound on the idler sheave 33 and the auxiliary sheave 35 is wound on a guide sheave 47 provided at the free end of the jib 4, and a hook F connected to an end of the wire rope W is engaged with the free end of the jib 4 (see FIGS. 4 and 5).

(e) Then, the wire rope W is hoisted (normally, the boom 3 is expanded with the wire rope W fixed). As a result, the jib 4 is lifted simultaneously with the retraction of the rod 61 by the hoisting force of the wire rope W until the left jib foot 41 comes into engagement with the main mounting portion 31a of the left mounting shaft 31, and the right jib foot 42 comes into engagement with the right jib mounting shaft 32 (see FIG. 6). Under this condition, the jib feet 41 and 42 and the connecting member 6 are aligned.

(f) When the wire rope W is further hoisted, the jib 4 is pivoted forwardly about the jib mounting shafts 31 and 32, and simultaneously the boom 3 is derricked down to a substantially horizontal position to obtain the condition shown in FIG. 7. Under this condition, fixing pins (not shown) are inserted into the pin holes 41a and 42a of the jib feet 41 and 42, respectively, thereby fixing the jib feet 41 and 42 to the jib mounting shafts 31 and 32.

(g) As shown by a phantom line in FIG. 7, a suspension rod S is mounted between the jib 4 and the forward end of the boom 3. Thus, the stretching of the jib 4 is completed.

FOLDING OPERATION OF THE JIB

The folding operation of the jib 4 is carried out in a manner reversed to the above-mentioned stretching operation. In summary, the suspension rod S is removed, and the fixing pins fixing the jib feet 41 and 42 to the jib mounting shafts 31 and 32 are remvoed under the condition shown in FIG. 7 where the boom 3 is in the substantially horizontal position, and the hook F is engaged with the free end of the jib 4. Then, the boom 3 is derricked up, and the wire rope W is loosened to pivot the jib downwardly about the jib mounting shafts 31 and 32 until the jib 4 comes into the suspended condition as shown in FIG. 6. Then, the jib 4 is lowered to be disengaged from the jib mounting shafts 31 and 32 as shown in FIGS. 4 and 5. Then, the jib 4 is twisted at about 270° about the axis x of the rod 61 in a direction reversed to that in the stretching operation, thus obtaining the condition shown in FIG. 2.

Under this condition, the guide roller 46 is opposed to the open end of the jib guide 5. Then, the boom 3 is contracted to let the guide roller 46 be inserted from the open end of the jib guide 5 and be moved in the slant channel portion 5a and the horizontal channel portion 5b. Thus, the jib 4 is pivoted upwardly about the auxiliary mounting portion 31b of the left jib mounting shaft 31, and is automatically drawn to the left side surface of the boom 3, thereby obtaining the folded condition shown in FIG. 1.

According to the stretching and folding device of the preferred embodiment as mentioned above, the lower beam 4a of the jib 4 under the folded condition shown in FIGS. 1, 8 and 9 is disposed above the rod 61 as the twist shaft by the distance $d_1$. That is, as compared with the prior art wherein the lower beam 2a is coaxial with the twist shaft, the jib 4 of the present invention is folded at a position above the twist shaft by the distance $d_1$. Further, the jib 4 is automatically raised to the folded position by contracting the boom 3 under the suspended condition shown in FIG. 2. In other words, it is unnecessary to raise the jib 4 after disposing the same aside the boom 3. Accordingly, good front view may be ensured.

Furthermore, the bracket 43 fixed to the jib 4 is slidable relative to the rod 61 fixed to the connecting member 6, and the connecting member 6 is located at the forward position spaced by the distance $d_2$ from the jib feet 41 and 42. In other words, the jib feet 41 and 42 are located at a position rearward from the connecting member 6 by the distance $d_2$ under the folded condition of the jib 4. Therefore, as compared with the prior art wherein the jib foot 21 is engaged with the jib mounting shaft 11 under the folded condition, the jib 4 of the present invention is shifted back toward the base end of the boom 3. Accordingly, when the crane is operated under the folded condition of the jib 4, the center of gravity of the boom 3 may be shifted toward the base end of the boom 3 owing to the shifted-back distance of the jib 4, thereby reducing an overturning moment of the crane. Therefore, the crane ability may be improved, and the weight balance of front and rear axles may be also improved by the weight of the boom during traveling of the crane.

In the folding operation of the jib 4, while the guide roller 46 is moved in the jib guide 5 (especially, the slant channel portion 5a) by contracting the boom 3, the jib 4 tends to move by its reaction toward the forward end of the boom 3 (that is, the connecting member 6 or the rod 61 tends to be relatively retracted), thus hindering smooth folding operation of the jib 4. Further, in the stretching operation of the jib 4 from the folded condition shown in FIG. 1, if the boom 3 is inclined downwardly in such that the forward end thereof is lowered, the jib 4 tends to be moved toward the forward end of the boom 3 when the fixation of the jib 4 is released.

However, according to the present invention, since the stopper 44 of the bracket 43 abuts against one of the projections 63 of the thrust plate 62 as shown in FIGS. 8 to 10 under the folded condition of FIGS. 1 and 2, the jib 4 cannot be moved toward the forward end of the boom 3 when the jib 4 is retracted from the condition of FIG. 2 to the condition of FIG. 1, and vice versa. Therefore, the folding and stretching operations may be smoothly carried out.

Although the connecting member 6 is in the advance condition as shown in FIG. 1 after the folding operation, the fixing pin P may be removed from the connecting member 6 to disengage the same from the jib mounting shaft 31 (the auxiliary mounting portion 31b) by expanding the boom 3, and the rod 61 may be rotated to retract the connecting member 6.

Figure 12:
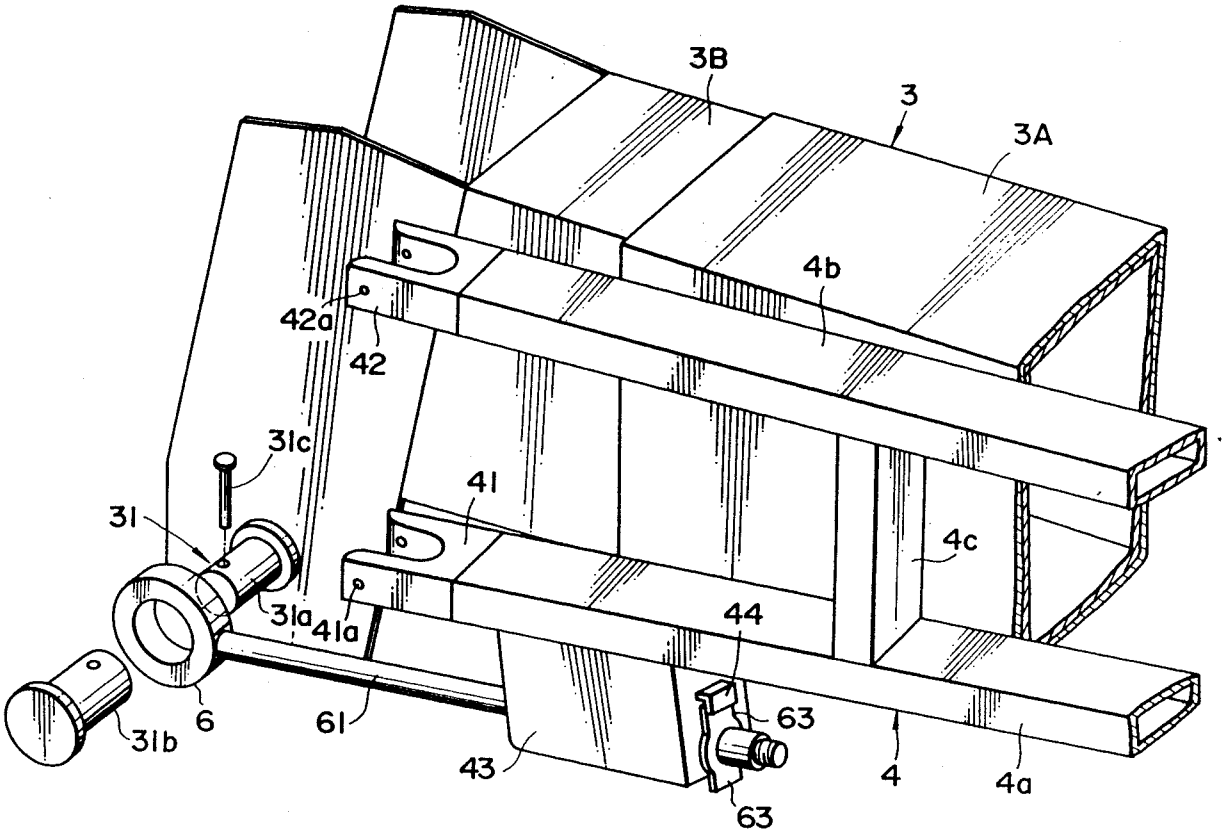
FIG. 12 is a view similar to FIG. 9, illustrating a second preferred embodiment of the present invention.

(2) Second Preferred Embodiment (see FIG. 12)

In contrast to the first preferred embodiment employing the forked connecting member 6, the second preferred embodiment employs a ring-like connecting member. Furthermore, the auxiliary mounting portion 31b of the jib mounting shaft 31 is formed by a hollow pin independent of the main mounting portion 31a. The independent auxiliary mounting member 31b is inserted to the ring-like connecting member 6, and is fitted with the main mounting portion 31a. Then, a fixing pin 31c is inserted into a pin hole 31d of the auxiliary mounting member 31b and a pin hole 31e of the main mounting portion 31a, thus detachably connecting the connecting member 6 to the jib mounting shaft 31. According to the second preferred embodiment, when the jib 4 is not used, the auxiliary mounting member 31b may be removed, so as to reduce a projecting distance of the jib mounting shaft 31 projecting from the left side surface of the boom 3. Accordingly, this construction is advantageous for the crane operation when the boom 3 is placed in a narrow space.

Figure 13:
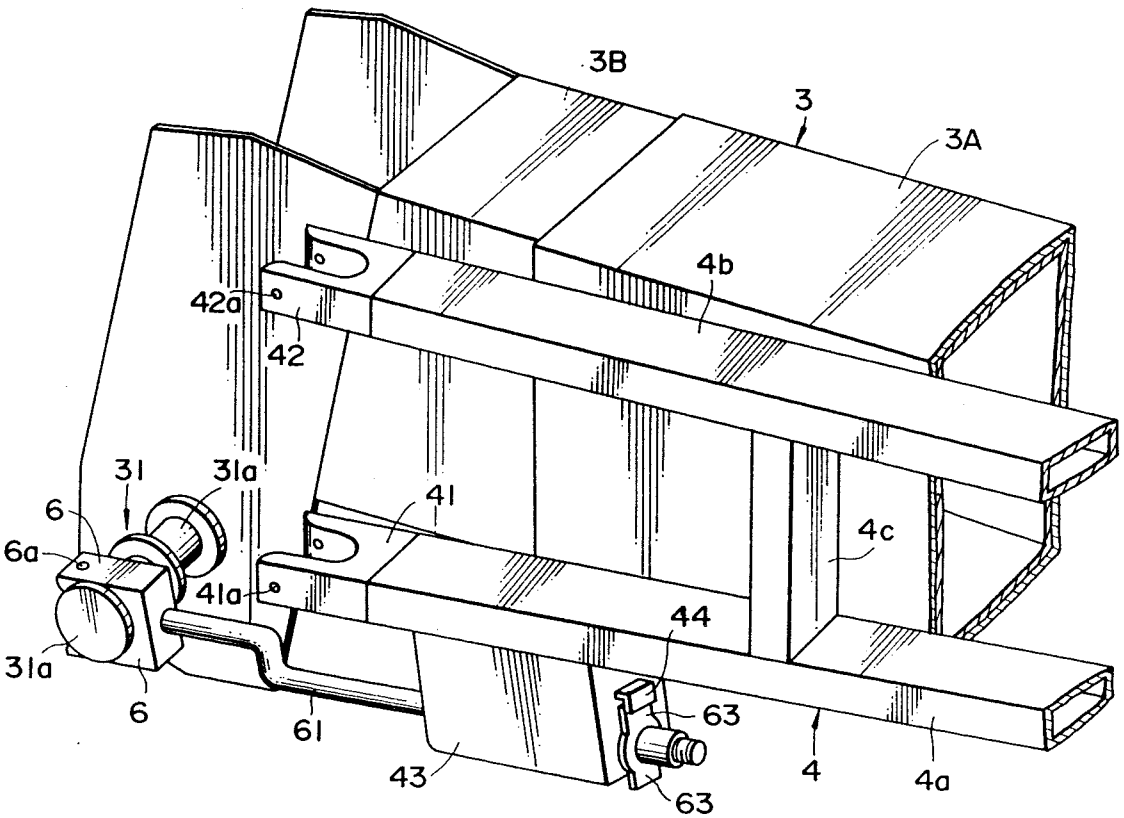
FIG. 13 is a view similar to FIG. 9, illustrating a third preferred embodiment of the present invention.
Figure 14:
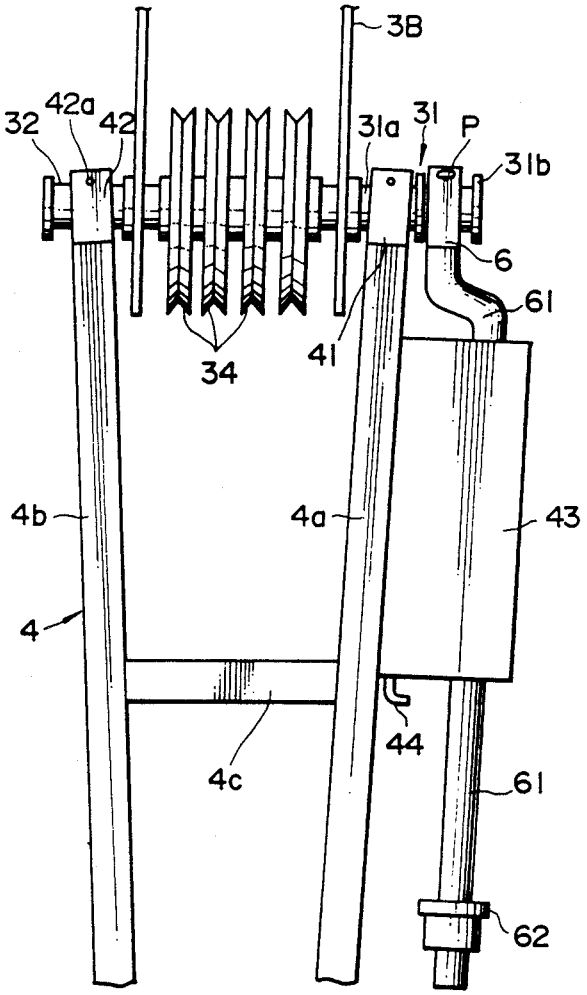
FIG. 14 is a view similar to FIG. 11, illustrating the third preferred embodiment.

(3) Third Preferred Embodiment (see FIGS. 13 and 14)

The rod 61 is cranked at its end portion near the connecting member 6 in such a manner that the connecting member 6 is offset to the left side surface of the forward end portion of the boom 3, so as to reduce the length of the auxiliary mounting portion 31b of the left jib mounting shaft 31. While the other construction is the same as the first preferred embodiment, it may be applied to the second preferred embodiment employing the ring-like connecting member and the auxiliary hollow mounting member independent of the main mounting portion of the jib mounting shaft.

Figure 15:
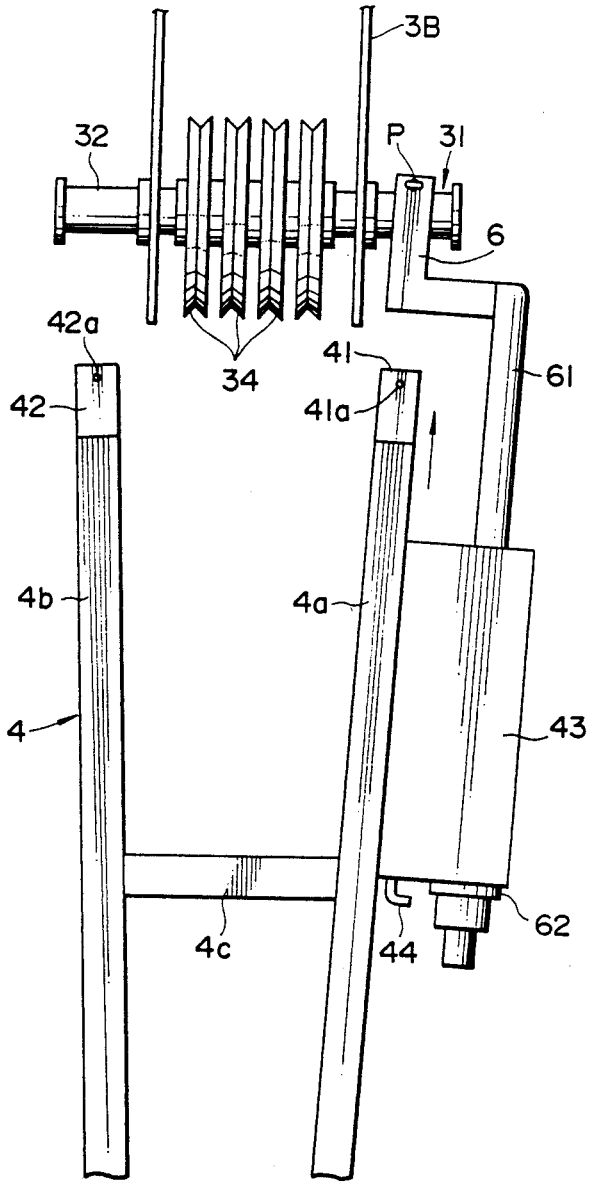
FIG. 15 is an enlarged elevational view of the essential part of a fourth preferred embodiment of the present invention under the condition corresponding to FIG. 5.
Figure 16:
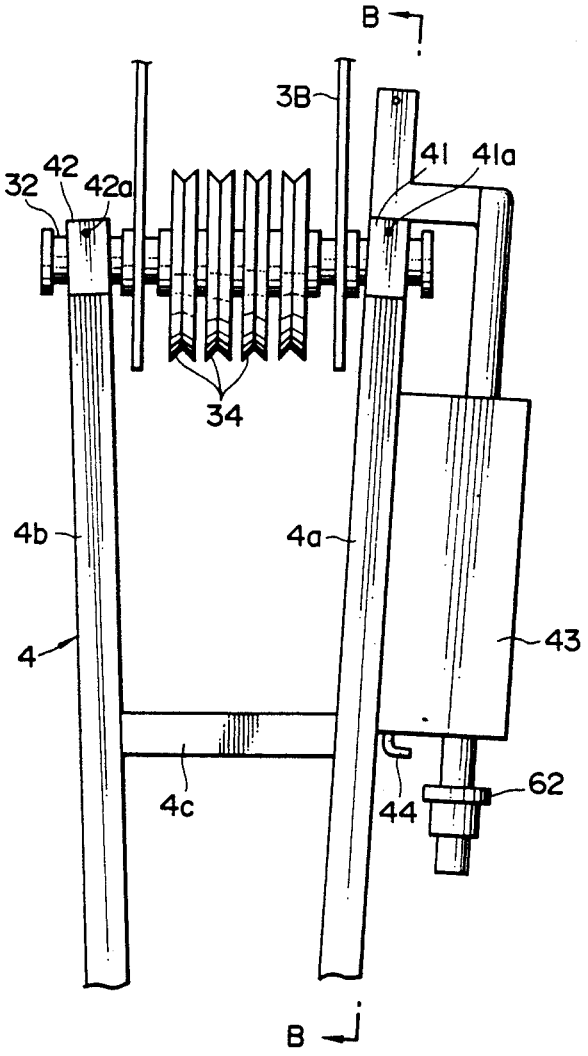
FIG. 16 is a view similar to FIG. 11, illustrating the fourth preferred embodiment.
Figure 17:
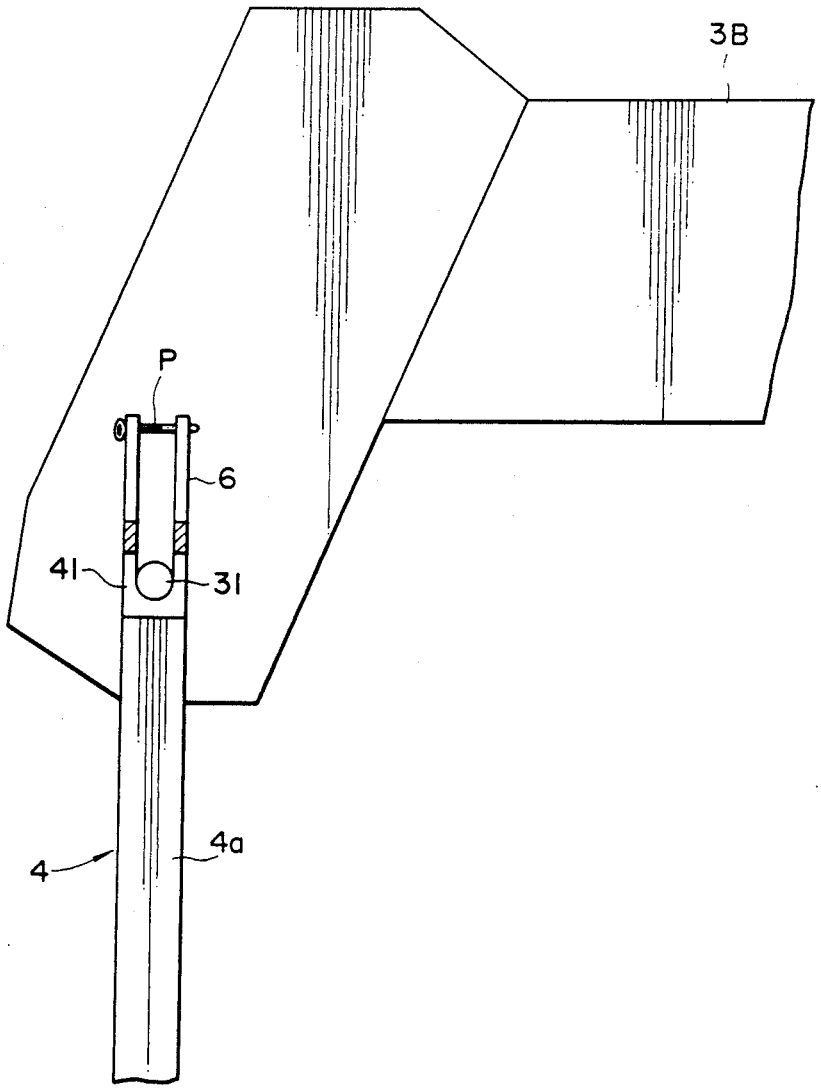
FIG. 17 is a cross section taken along the line B—B in FIG. 16.

(4) Fourth Preferred Embodiment (see FIGS. 15 to 17)

The construction of the rod 61 is substantially similar to the third preferred embodiment in that the rod 61 is cranked at its end portion near the connecting member 6, with the exception that the crank portion of the rod 61 and the connecting member 6 is formed by a pair of parallel plates adapted to diametrically hold the jib mounting shaft 31. As shown in FIG. 15 illustrating the twisted condition of the jib 4, the jib foot 41 is aligned with the connecting member 6. When the jib 4 is raised in a direction of arrow X in FIG. 15, an upper end surface of the jib foot 41 is brought into abutment against a lower surface of the crank portion, and urges the same upwardly until the jib foot 41 comes into engagement with the jib mounting shaft 31 as shown in FIG. 16.

According to the fourth preferred embodiment, it is unnecessary to provide the auxiliary mounting portion 31b as employed in the previous preferred embodiments, so that a lateral projecting distance of the jib mounting shaft may be minimized.

Figure 18:
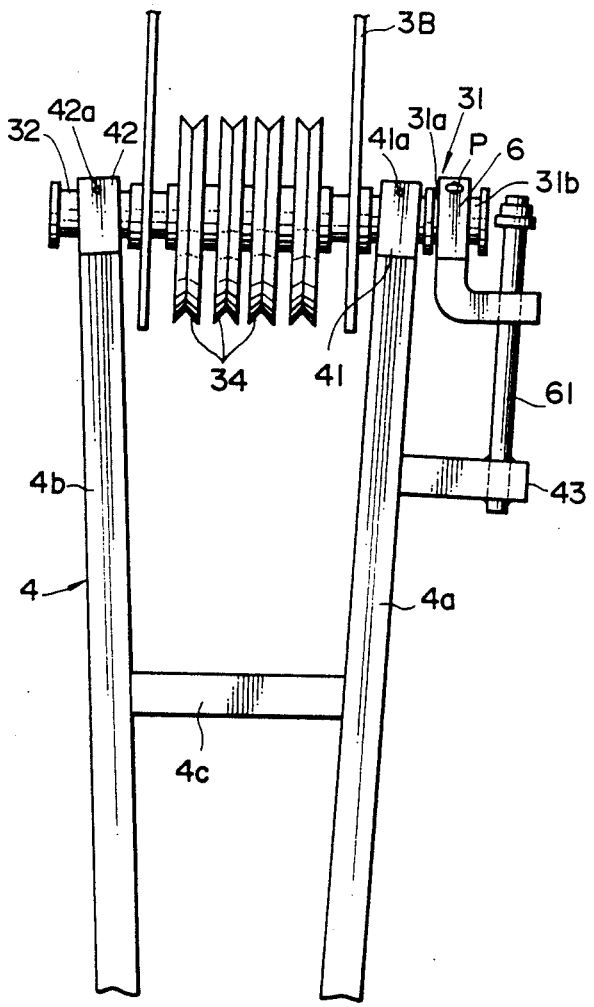
FIG. 18 is a view similar to FIG. 11, illustrating a fifth preferred embodiment of the present invention.

(5) Fifth Preferred Embodiment (see FIG. 18)

The rod 61 is fixed at its one end to the bracket 43 which is also fixed to the jib 4. The connecting member 6 having an L-shaped configuration as viewed in plan is relatively rotatably and slidably connected to the rod 61.

Figure 19:
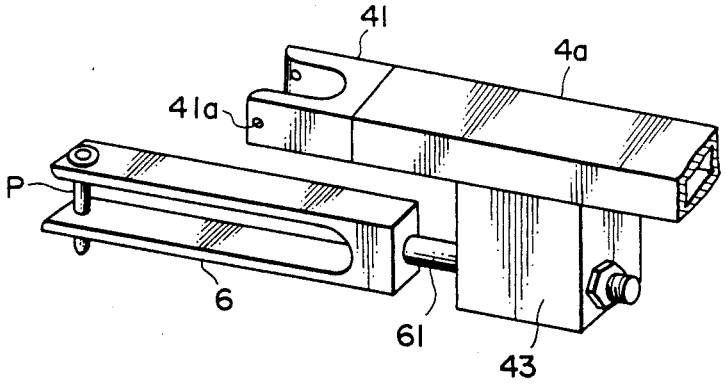
FIG. 19 is an enlarged perspective view of a sixth preferred embodiment of the present invention.

(6) Sixth Preferred Embodiment (see FIG. 19)

The rod 61 is rotatably but unslidably supported to the bracket 43 fixed to the lower beam 4a of the jib 4, and the rod 61 is fixed to an end of the connecting member 6 having an elongated forked portion.

With this construction, when the jib 4 is raised under the twisted condition in the jib stretching operation, the connecting member 6 is moved together with the jib 4, and is slid with respect to the jib mounting shaft 3 within the range of the elongated forked portion until the jib foot 41 comes into engagement with the jib mounting shaft 31. In a modified construction, the forked connecting member 6 may be formed into an elongated ring-like construction similar to the second preferred embodiment as shown in FIG. 12.

(7) Seventh Preferred Embodiment

In the previous preferred embodiments, a slide stroke of the connecting member 6 relative to the jib 4 or the jib mounting shaft 31 is relatively large so as to shift back the jib 4 toward the base end of the boom 3 in the folding operation. However, in the case where such shiftback of the jib 4 is unnecessary, the slide stroke of the connecting member 6 may be reduced to an amount required for moving the jib feet 41 and 42 from the position below the jib mounting shafts 31 and 32 to the position where the jib feet 41 and 42 are engaged with the jib mounting shafts 31 and 32.

Figure 20:
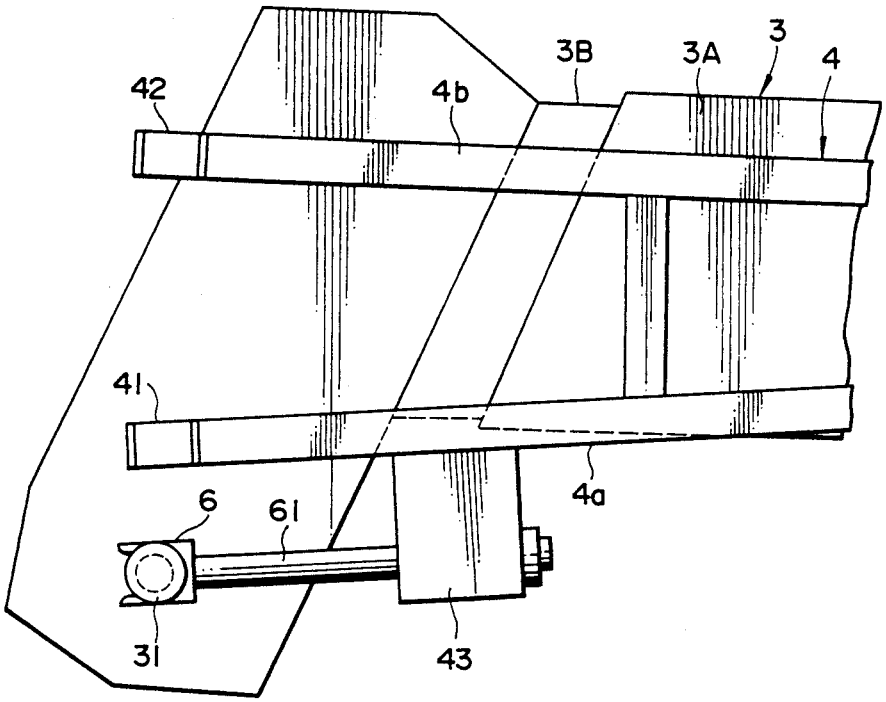
FIG. 20 is a view similar to FIG. 8, illustrating a seventh preferred embodiment.

Alternatively, as shown in FIG. 20, the jib feet 41 and 42 may be formed into a U-shaped configuration, so as to allow the jib feet 41 and 42 to be brought into engagement with the jib mounting shafts 31 and 32 by twisting the jib 4 without the relative sliding motion of the connecting member 6.

Figure 21:
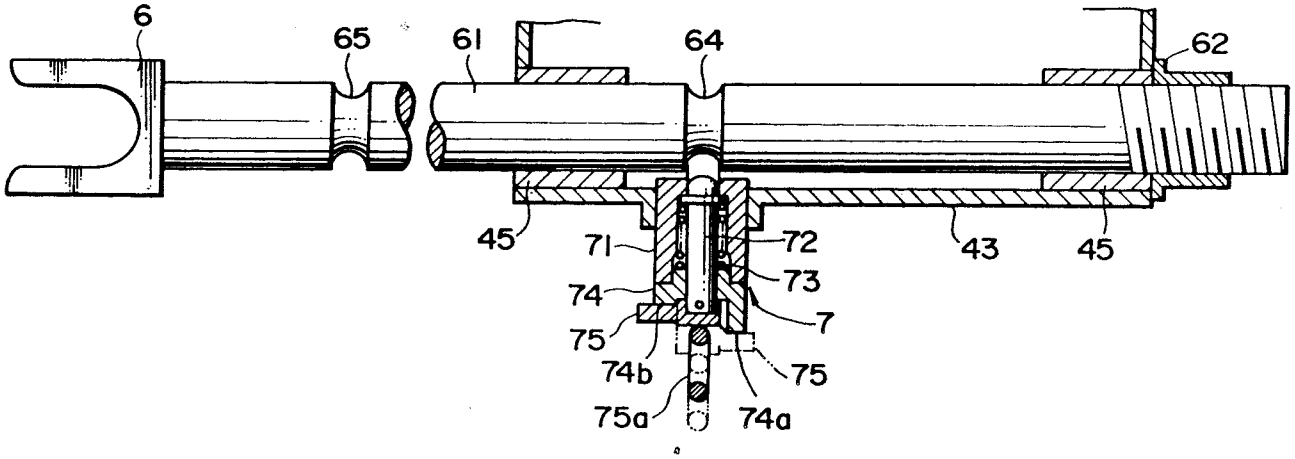
FIG. 21 is an enlarged sectional side view of an eighth preferred embodiment of the present invention.
Figure 22:
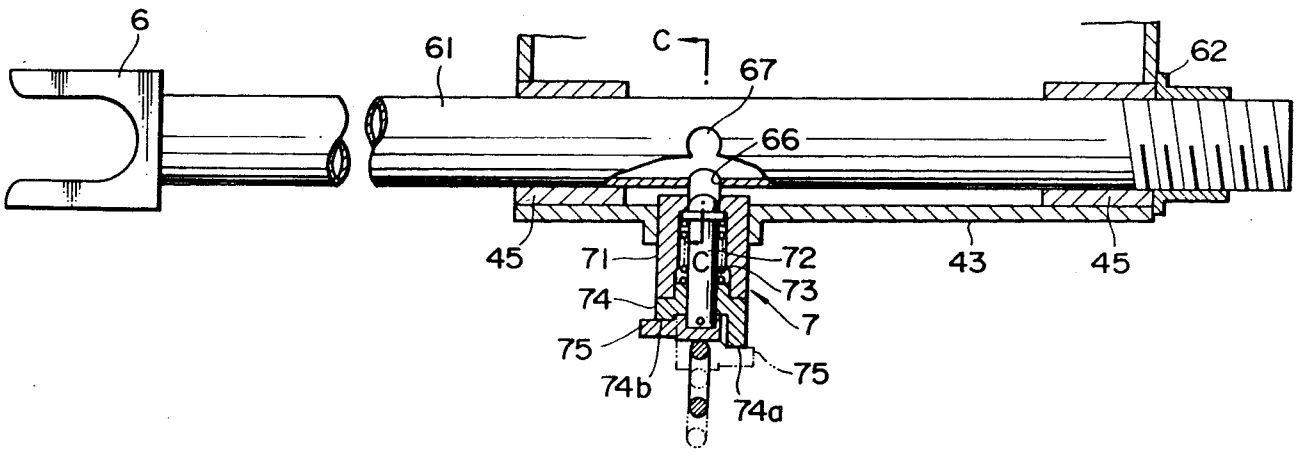
FIG. 22 is a view similar to FIG. 21, illustrating a ninth preferred embodiment of the present invention.

(8) Eighth Preferred Embodiment (see FIG. 21)

In contrast to the previous preferred embodiments employing the thrust plate 62 having the projections 63 abuttable against the stopper 44 of the bracket 43 for the purpose of maintaining the advance condition of the connecting member 6 (i.e., preventing the relative retract movement of the connecting member 6), the eighth preferred embodiment employs a circumferential groove 64 formed on the outer circumference of the rod 61 and a fixing pin mechanism 7 mounted to the bracket 43 at a position corresponding to the circumferential groove 64 under the advance condition of the connecting member 6. The fixing pin mechanism 7 is constructed of a cylindrical pin holder 71, a fixing pin 72 encased in the pin holder 71 in such a manner as to be projectable therefrom and come into engagement with the circumferential groove 64, a spring 73 for biasing the fixing pin 72 against the outer circumference of the rod 61, and a spring seat 74 for seating the spring 73. The fixing pin 72 is provided at its lower end with a lever 75 having a knob **75*a*. The lever 75 is engaged with an outer end surface of the spring seat 74. The outer end surface of the spring seat 74 is comprised of a low level portion 74*a*, a high level portion 74*b*, and an inclined surface connecting both the portions 74*a* and 74*b* to form a circumferential cam surface. In the folding operation of the jib 4, the lever 75 is engaged with the low level portion 74*b* of the spring seat 74 to project the pin 72 out of the pin holder 71 and make the pin 72 abut against the outer circumference of the rod 61. When the connecting member 6 is brought into the advance condition as shown in FIGS. 4 and 5, the fixing pin 72 is brought into engagement with the circumferential groove 64 of the rod 61 by the biasing force of the spring 73, thereby preventing the retract movement of the connecting member 6. On the other hand, in the stretching operation of the jib 4, the lever 75 is engaged with the high level portion 74*a* of the spring seat 74 to retract the fixing pin 72 against the biasing force of the spring 73 and thereby maintain the pin 72 disengaged from the circumferential groove 64 of the rod 61**.

The rod 61 is also formed with another circumferential groove 65 at a position near the connecting member 6, so as to maintain the retract condition of the connecting member 6 under the folded condition of the jib 4.

(9) Ninth Preferred Embodiment (see FIGS. 22 to 25)

In the ninth preferred embodiment, the rod 61 is a hollow shaft formed with a first pin hole 66 and a second pin hole 67 arranged on the same circle i.e., at the same axial position on the hollow shaft, and circumferentially spaced at an angle same as the twist angle (about 270°) of the jib 4. The bracket 43 is provided with the same fixing pin mechanism 7 as used in the eighth preferred embodiment shown in FIG. 21, so that when the jib 4 is in the folded condition, the fixing pin 72 is engaged with the first pin hole 66, while when the jib 4 is in the stretched condition, the fixing pin 72 is engaged with the second pin hole 67.

Figure 23:
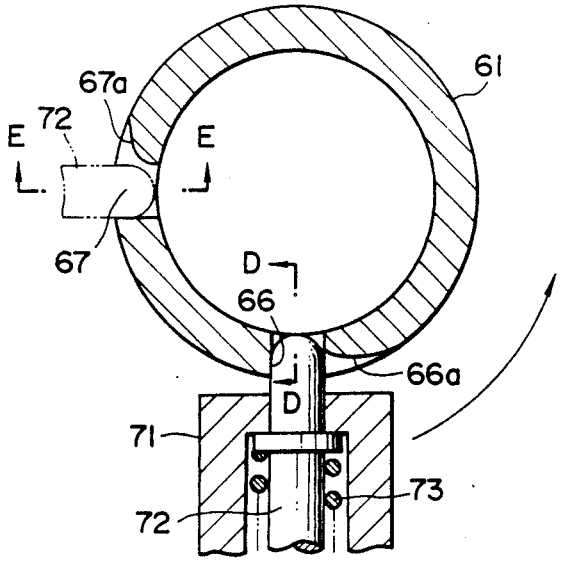
FIG. 23 is an enlarged cross section taken along the line C—C in FIG. 22.
Figure 24:
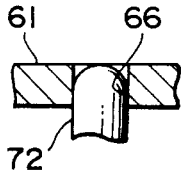
FIG. 24 is a cross section taken along the line D—D in FIG. 23.
Figure 25:
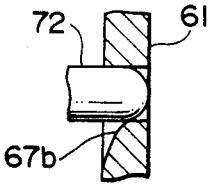
FIG. 25 is a cross section taken along the line E—E in FIG. 23.
Figure 26:
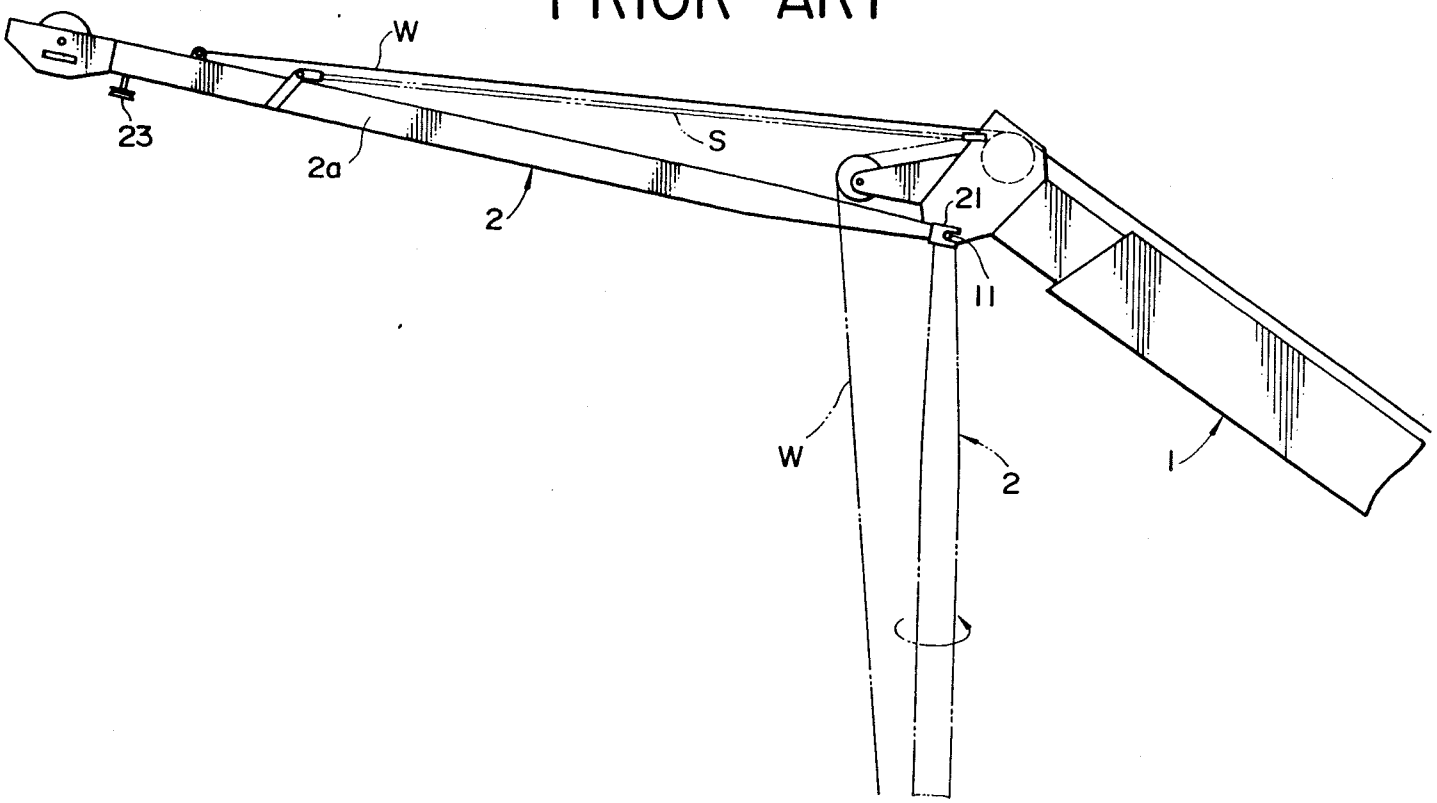
FIG. 26 PRIOR ART
FIG. 26 is a side view of the jib under the stretched condition in the prior art.
Figure 27:
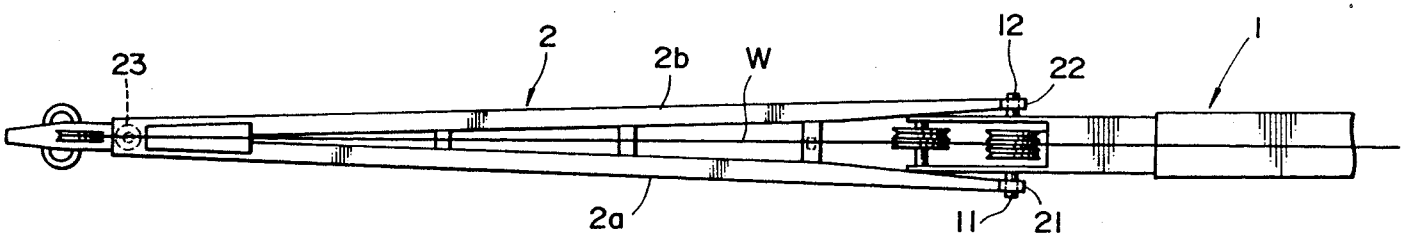
FIG. 27 PRIOR ART
FIG. 27 is a plan view of FIG. 26.
Figure 28:
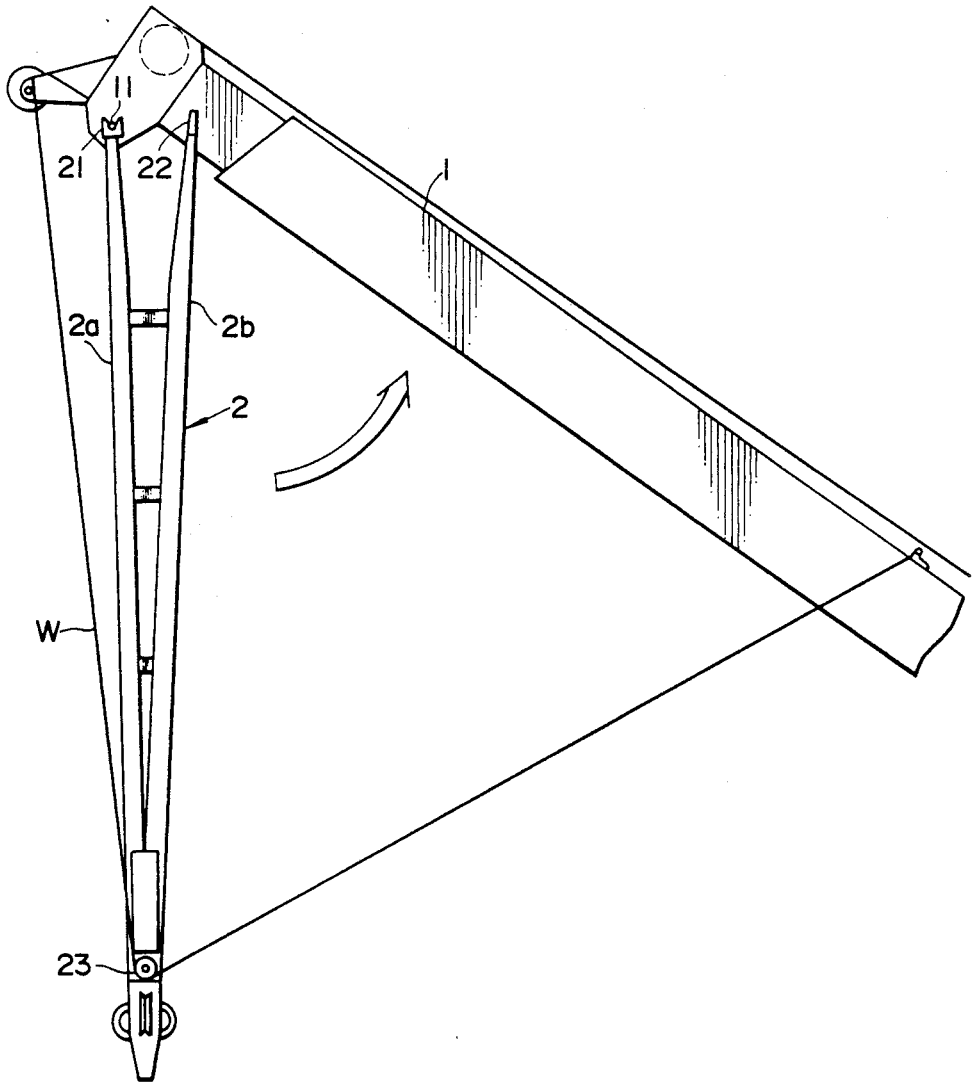
FIG. 28 PRIOR ART
FIG. 28 is a side view of the jib under the suspended condition after twisted from the position shown by a phantom line in FIG. 26.
Figure 29:
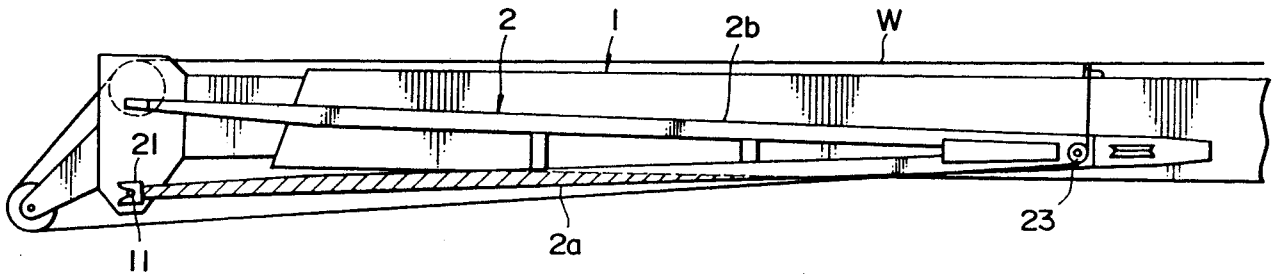
FIG. 29 PRIOR ART
FIG. 29 is a side view of the jib under the folded condition after drawn to the boom from the position shown in FIG. 28.

As shown in FIG. 23, the first pin hole 66 is formed with a slant surface **66*a* in the circumferential direction of the rod 61 so that the fixing pin 72 may be automatically released from the pin hole 66 in a direction of arrow Y by the twisting force in twisting the jib 4 in the jib stretching operation. Similarly, the second pin hole 67 is also formed with a slant surface 67*a* so as to ensure automatic disengagement of the fixing pin 72 from the pin hole 67 in the direction counter to the arrow Y in the jib folding operation. Furthermore, as shown in FIG. 24, the first pin hole 66 has a straight shape as viewed in cross section taken along the axis of the rod 61, so that the fixing pin 72 may not be released from the first pin hole 66 in the axial direction of the rod 61 to maintain the advance condition of the connecting member 6 under the jib folded condition. On the other hand, as shown in FIG. 25, the second pin hole 67 is formed with a slant surface 67*b* in the retract direction of the connecting member 6, so that the fixing pin 72 may be released from the second pin hole 67 in the axial direction of the rod 61 to allow the relative retract movement of the connecting member 6** under the jib stretching condition.

According to the ninth preferred embodiment, the connecting member 6 may be maintained in the advance condition during the jib folding operation. In addition, when the jib 4 is twisted in the folding direction, the fixing pin 72 comes into engagement with the first pin hole 66, while when the jib 4 is twisted in the stretching direction, the fixing pin 72 comes into engagement with the second pin hole 67. Therefore, the jib 4 may be precisely twisted at the predetermined twist angle defined by the location of the first and second pin holes 66 and 67. That is, in the jib folding operation, the guide roller 46 is precisely positioned to be opposed to the open end of the jib guide 5 as shown in FIG. 2, and in the jib stretching operation, the jib foots 41 and 42 are precisely positioned just below the jib mounting shafts 31 and 32.

What is claimed is:

1. In a crane including a telescopic boom having a forward end portion provided with a pair of jib mounting shafts laterally projecting from opposite side surfaces of said forward end portion, and a strut type jib having a base end portion provided with a pair of jib feet adapted to be detachably connected with said jib mounting shafts, wherein said jib may be folded along a vertical side surface of said boom in a jib folded condition where said jib feet are disposed in vertical alignment, while said jib may be stretched in a stretching operation from said forward end portion of said boom with said jib feet connected to said jib mounting shafts, a jib stretching and folding device comprising:

a connecting member comprising means for being detachably connected to a one of said jib mounting shafts to which a lower one of said jib feet arranged at a lower position in the jib folded condition is to be connected in the stretching operation, independently of said lower one of said jib feet and in such a manner as to be rotatable about said one jib mounting shaft, and a supporting shaft mounted to a lower member of said jib at the base end portion of said jib in such a manner as to extend below said lower member when in the jib folded condition, wherein said connecting member is supported on said supporting shaft and wherein said connecting member is rotatable about said jib, whereby said jib can rotate on said one of said jib mounting shafts such that said lower one of said jib feet can pivot around said one of said jib mounting shafts.

2. The jib stretching and folding device as defined in claim 1, wherein said connecting member is supported on said supporting shaft in such a manner as to be slidable along said supporting shaft to advance and retract relative to the base end portion of said jib, and further comprising means for fixing said connecting member in an advance condition.

3. The jib stretching and folding device as defined in claim 1 further comprising a bracket mounted on said lower member of said jib, wherein said supporting shaft comprises a rod supported at said bracket in such a manner as to be rotatable about an axis of said rod and extend in substantially parallel relationship to said lower member of said jib, wherein said connecting member is connected to an end of said rod.

4. The jib stretching and folding device as defined in claim 2 further comprising a bracket mounted on said lower member of said jib, wherein said supporting shaft comprises a rod supported a said bracket in such a manner as to be rotatable about an axis of said rod extending in substantially parallel relationship to said lower member of said jib wherein said connecting member is connected to an end of said rod.

5. The jib stretching and folding device as defined in claim 4, wherein said means for fixing said connecting member in the advance condition comprises a stopper provided on said bracket and a member fixed to said rod and abutting against said stopper from the side thereof facing the base end portion of said jib when the jib is in the jib folded condition.

6. The jib stretching and folding device as defined in claim 4, wherein said means for fixing said connecting member in the advance condition comprises a circumferential groove formed on said rod and a pin mechanism mounted to said bracket, said pin mechanism comprising a fixing pin engageable with said circumferential groove in the advance condition of said connecting member and a spring for biasing said fixing pin in such a direction as to bring said fixing pin into engagement with said circumferential groove.

7. The jib stretching and folding device as defined in claim 4, wherein said rod comprises a hollow shaft, and said means for fixing said connecting member in the advance condition comprises a first pin hole formed through a circumferential wall of said hollow shaft and a fixing pin mechanism mounted to said bracket, said fixing pin mechanism comprising a fixing pin engageable with said first pin hole in the folded condition of said jib and a spring for biasing said fixing pin in such a direction as to bring said fixing pin into engagement with said pin hole.

8. The jib stretching and folding device as defined in claim 7 further comprising a second pin hole formed through the circumferential wall of said hollow shaft and adapted to be engaged with said fixing pin in the stretched condition of said jib, wherein said first and second pin holes are arranged at the same axial position of said hollow shaft.

9. The jib stretching and folding device as defined in claim 7 or 8, wherein said pin hole is formed with a slant surface in a circumferential direction of said rod for permitting said fixing pin to disengage from said pin hole in the circumferential direction of said rod.

10. The jib stretching and folding device as defined in claim 3, 4, 5, 6, 7 or 8, wherein an end portion of said rod is bent in such a manner that said connecting member is located close to the side surface of said boom.

11. The jib stretching and folding device as defined in claim 9, wherein an end portion of said rod is bent in such a manner that said connecting member is located close to the side surface of said boom.

12. The jib stretching and folding device as defined in claim 3, 4, 5, 6, 7 or 8, wherein an end portion of said rod is bent in such a manner that the lower jib foot and the connecting member are aligned in the stretched condition of the jib, and wherein the bent portion and said connecting member are formed by a pair of parallel plates diametrically holding said jib mounting shaft.

13. The jib stretching and folding device as defined in claim 9, wherein an end portion of said rod is bent in such a manner that the lower jib foot and the connecting member are aligned in the stretched condition of the jib, and wherein the bent portion and said connecting member are formed by a pair of parallel plates diametrically holding said jib mounting shaft.

14. The jib stretching and folding device as defined in claim 1, 2, 3, 4, 5, 6, 7 or 8, wherein said connecting member has a forked structure comprises means for disengageably connected to said jib mounting shaft.

15. The jib stretching and folding device as defined in claim 9, wherein said connecting member has a forked structure comprising means for disengageably connected to said jib mounting shaft.

16. The jib stretching and folding device as defined in claim 10, wherein said connecting member has a forked structure comprising means for disengageably connected to said jib mounting shaft.

17. The jib stretching and folding device as defined in claim 11, wherein said connecting member has a forked structure comprising means for disengageably connected to said jib mounting shaft.

18. The jib stretching and folding device as defined in claim 1, 2, 3, 4, 5, 6, 7 or 8, wherein said connecting member has a ring-like structure, and said jib mounting shaft to be connected with said ring-like connecting member comprises a main mounting portion fixed to said boom and a hollow pin-like auxiliary mounting portion detachably connected to said main mounting portion.

19. The jib stretching and folding device as defined in claim 9, wherein said connecting member has a ring-like structure, and said jib mounting shaft to be connected with said ring-like connecting member comprises a main mounting portion fixed to said boom and a hollow pin-like auxiliary mounting portion detachably connected to said main mounting portion.

20. The jib stretching and folding device as defined in claim 10, wherein said connecting member has a ring-like structure, and said jib mounting shaft to be connected with said ring-like connecting member comprises a main mounting portion fixed to said boom and a hollow pin-like auxiliary mounting portion detachably connected to said main mounting portion.

21. The jib stretching and folding device as defined in claim 11, wherein said connecting member has a ring-like structure, and said jib mounting shaft to be connected with said ring-like connecting member comprises a main mounting portion fixed to said boom and a hollow pin-like auxiliary mounting portion detachably connected to said main mounting portion.

* * * * *